United States Patent [19]

Stahlecker et al.

[11] Patent Number: 4,653,265

[45] Date of Patent: Mar. 31, 1987

[54] OPEN-END SPINNING MACHINE HAVING A PLURALITY OF SPINNING UNITS AND A MOVABLE SERVICING APPARATUS

[75] Inventors: Fritz Stahlecker, Josef-Neidhart-Strasse 18, 7347 Bad Überkingen; Hans Raasch, Monchen-Gladbach, both of Fed. Rep. of Germany

[73] Assignees: Fritz Stahlecker; Stahlecker: Hans, both of Fed. Rep. of Germany

[21] Appl. No.: 751,123

[22] Filed: Jul. 2, 1985

[30] Foreign Application Priority Data

Jul. 4, 1984 [DE] Fed. Rep. of Germany ..... 3424511

[51] Int. Cl.[4] ..... D01H 7/882; D01H 11/00

[52] U.S. Cl. ..... 57/406; 57/78; 57/105; 57/302

[58] Field of Search ..... 57/264, 263, 302, 404, 57/405, 406, 78, 88, 104, 105

[56] References Cited

U.S. PATENT DOCUMENTS

| | | | |
|---|---|---|---|
| 3,779,620 | 12/1973 | Stahlecker | 57/406 X |
| 4,380,143 | 4/1983 | Abduganiev et al. | 57/88 X |
| 4,498,283 | 2/1985 | Kodama et al. | 57/304 X |
| 4,548,030 | 10/1985 | Lauschke et al. | 57/404 X |

FOREIGN PATENT DOCUMENTS

| | | | |
|---|---|---|---|
| 2212194 | 9/1973 | Fed. Rep. of Germany | 57/105 |
| 2711163 | 9/1978 | Fed. Rep. of Germany | 57/263 |
| 2360296 | 3/1982 | Fed. Rep. of Germany . | |
| 593419 | 5/1959 | Italy | 57/88 |

*Primary Examiner*—Stuart S. Levy
*Assistant Examiner*—Joseph J. Hail, III
*Attorney, Agent, or Firm*—Barnes & Thornburg

[57] ABSTRACT

An open-end spinning machine is provided having a servicing apparatus that can be moved along a series of spinning units, each unit containing one spinning rotor assembly comprising a shaft and a rotor. It is provided that in the individual spinning units, the shafts of the spinning rotor assemblies are disposed in wedge-shaped gaps formed by pairs of supporting disks and the shafts are driven by a tangential belt. The servicing apparatus contains a brake that can be applied to the rotor when servicing of a unit is required. The rotor is stopped while, at the same time, the drive of the tangential belt is interrupted via a bracket pulley that can be moved away from its operating position. In addition, members are provided for securing the spinning rotor in its operating position during the braking.

24 Claims, 12 Drawing Figures

FIG. 6
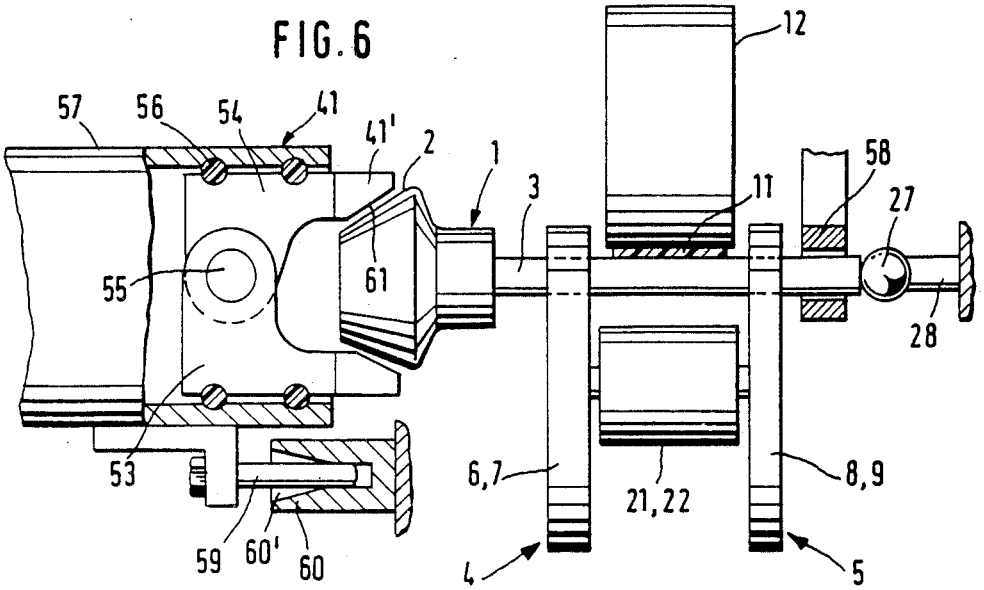
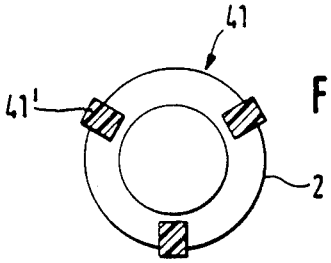
FIG. 7
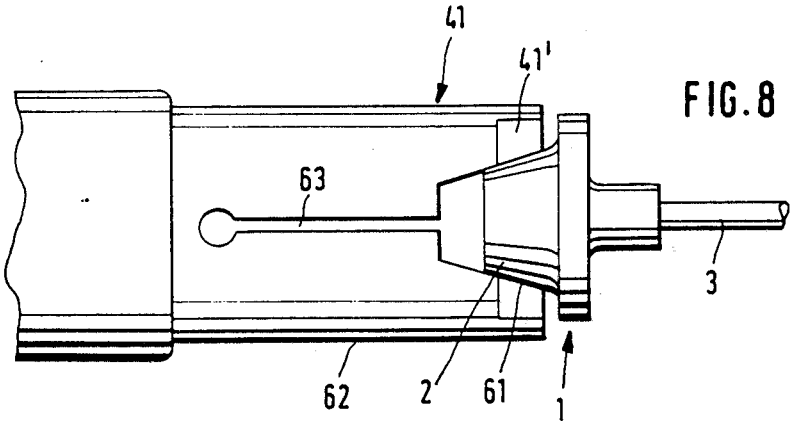
FIG. 8

OPEN-END SPINNING MACHINE HAVING A PLURALITY OF SPINNING UNITS AND A MOVABLE SERVICING APPARATUS

BACKGROUND AND SUMMARY OF THE INVENTION

This invention relates to an open-end spinning machine having a plurality of spinning units that are arranged next to one another and each containing a spinning rotor connected to a shaft. The shaft is radially disposed in a wedge-shaped gap formed by a pair of supporting disks and is driven by means of a tangential belt. The belt is biased in the direction of the shaft by means of a pressure pulley arranged on a movable arm that is biased by a spring. The machine has at least one movable servicing apparatus that can be applied to each spinning unit. The servicing apparatus contains means for exposing the spinning rotor and means for moving the arm with the pressure pulley into an inoperative position.

An open-end spinning machine of the general type is disclosed in German DE-PS No. 23 60 296. The shafts of the spinning rotors of the spinning units are disposed in normal radial bearings. For stopping the spinning rotor, the movable servicing apparatus operates a lever bar system via which the arm with with the pressure pulley is moved to an inoperative position. At the same time, a brake present in each spinning unit is applied to the rotor shaft. In the case of open-end spinning machines used in practice, the rotor shafts, deviating from the construction disclosed in DE-PS No. 23 60 296, are disposed in wedge-shaped gaps formed by supporting disks. In these open-end spinning machines, the brake of the individual spinning units is designed in such a way that it is applied to the rotor shaft from the same side as the tangential belt when the tangential belt is lifted off for the purpose of interrupting the drive. The brake will then take over the securing of the rotor shaft and thus of the whole spinning rotor in its operating position. The brake is applied to the shaft of the spinning rotor next to the tangential belt. Because of the relatively small diameter of the shafts of the spinning rotors, relatively high braking forces must be applied in order to achieve effective braking. These relatively high braking forces result in increased wear of the brake linings. In addition, the diameter of the shaft cannot be decreased which would be desirable in the case of transition to significantly higher speeds. The brake that is applied to the shaft in the axial direction of the shaft also requires a certain space, such that the length of the shaft cannot be decreased at all or cannot be decreased significantly which would be desirable for very high speeds.

An objective of the present invention is the provision of an open-end spinning machine wherein constructive limitations in the area of the bearings of the spinning rotors are decreased. This objective is achieved by providing the servicing apparatus with a brake that can be applied to the rotor and by providing means that secure the spinning rotor in the operating position when the pressure pulley is moved away.

Since the braking of the spinning rotor no longer takes place at the rotor shaft, the space requirements are decreased. Accordingly, the supporting disks can be moved closer together while the rotor shaft, at the same time, can be designed to be shorter. Since relatively high braking forces no longer affect the shaft, it may have a smaller diameter without the danger of unacceptable heating and/or deformation. The braking at the rotor has the advantage that the application of the brake takes place at a relatively large circumference so that the necessary braking force can be lowered. In addition, the brake that is susceptible to wear is part of the servicing apparatus. In the construction, checking or regular maintenance can be carried out much more easily. Means need only be provided for securing the operating position of the spinning rotor which in most cases are not subjected to significant wear.

In an advantageous development of the present invention, the means for securing the spinning rotor in its operating position are part of the servicing apparatus which can be applied to the exposed rotor. These means therefore do not have to be provided for each spinning unit but only for the servicing apparatus. In this development, it is especially easy from a constructive point of view, when the means for the securing of the spinning rotor in its operating position and the brake are designed as a structural component that can be applied to the rotor jointly.

In another advantageous development of the invention, it is provided that the brake contains tong-type grippers which can be applied to the rotor in the radial direction by means of brake shoes. These tong-type grippers may take over the securing of the spinning rotor in its operating position. It is advantageous that the brake shoes have profiling and reach around the profiling of the rotor from the outside. This results in axial as well as in radial securing.

In a further development of the invention, the brake can be applied in an axial direction toward the rotor and the shaft of the spinning rotor is supported by a stop in the axial direction. In this embodiment, the spinning rotor is clamped between the brake and the axial stop so that it is secured in its position. In this case, it is advantageous when the brake, by means of a conically expanding brake lining, in the axial direction, can be applied to the exterior side of the rotor having at least approximately the same conical contour.

In a further development of the invention, the brake is provided with centering elements which in the case of the axial application to the rotor of a spinning unit, engage in counterparts, which are arranged at the spinning unit in a position that is aligned precisely with the rotor plate. By means of this measure, in the case of an application of the brake, an alignment with respect to the rotor is achieved so that this rotor is gripped precisely in its operating position and can be held there.

In a further development of the invention, each spinning unit is equipped with means for fixing the operating position. These means are applied to the shaft of the spinning rotor. In this case, the brake of the servicing apparatus generally must contribute nothing to securing of the spinning rotor in its operating position, even if this is possible as a support. in the case of a simple embodiment of the invention, it is provided that each spinning unit is equipped with at least one stationary stop which is located at a small distance opposite the shaft on the side that faces away from the wedge-shaped gap. In the case of another embodiment of the invention, it is provided that each spinning unit is equipped with a supporting disk that can be applied to the shaft by the servicing apparatus. This disk then takes over the load by means of which the shaft of the spinning rotor is pressed into the wedge-shaped gap when the pressure pulley and the tangential belt for the interruption of the drive are moved away from the shaft of the spinning rotor.

In order to keep the cost as low as possible in this case, it is advantageous when the supporting disk be mounted on holding elements carrying the pressure pulley in such a way that when the means for moving away of the pressure pulley are operated, the supporting disk can be applied to the shaft.

Other objects, advantages and novel features of the present invention will become apparent from the following detailed description of the invention when considered in conjunction with the accompanying drawings.

BRIEF DESCRIPTION OF THE DRAWINGS

FIG. 6 is a view similar to that of FIG. 2 of an embodiment including a device that is designed as a stationary stop for securing the operating position of the spinning rotor and of a tong-type brake of the servicing apparatus;

FIG. 7 is a detail corresponding to FIG. 6 or 8;

FIG. 8 is a view of a brake of a servicing apparatus that can be applied axially to a spinning rotor in accordance with the present invention;

DETAILED DESCRIPTION OF THE DRAWINGS

Figure 1:
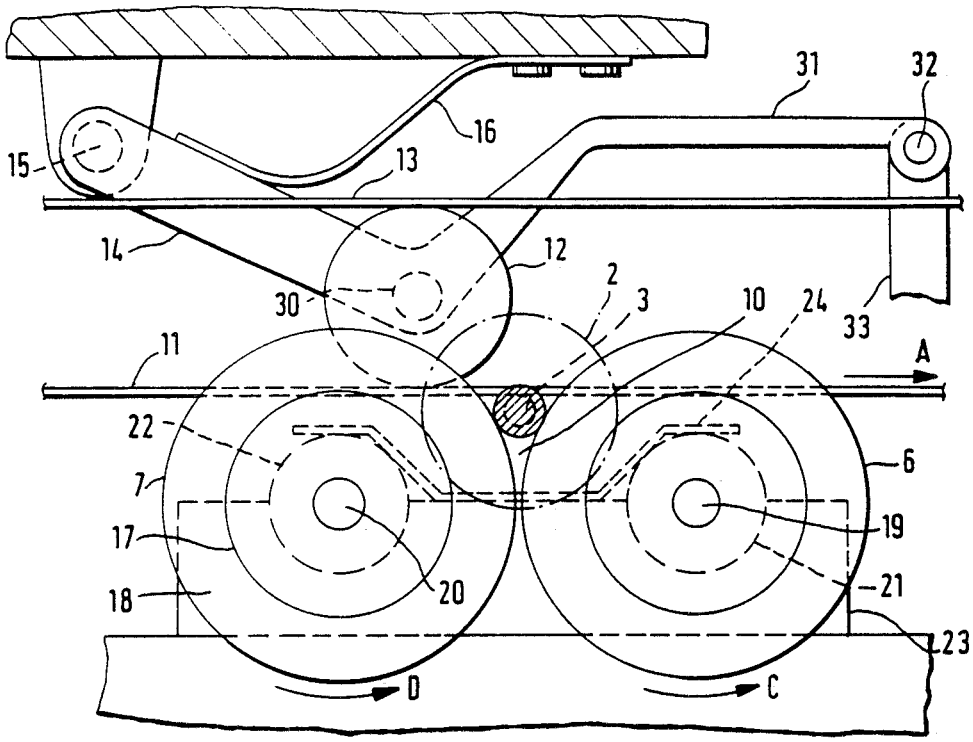
FIG. 1 shows a partial cut view in the axial direction of the shaft of a spinning rotor and bearing in accordance with the present invention.
Figure 2:
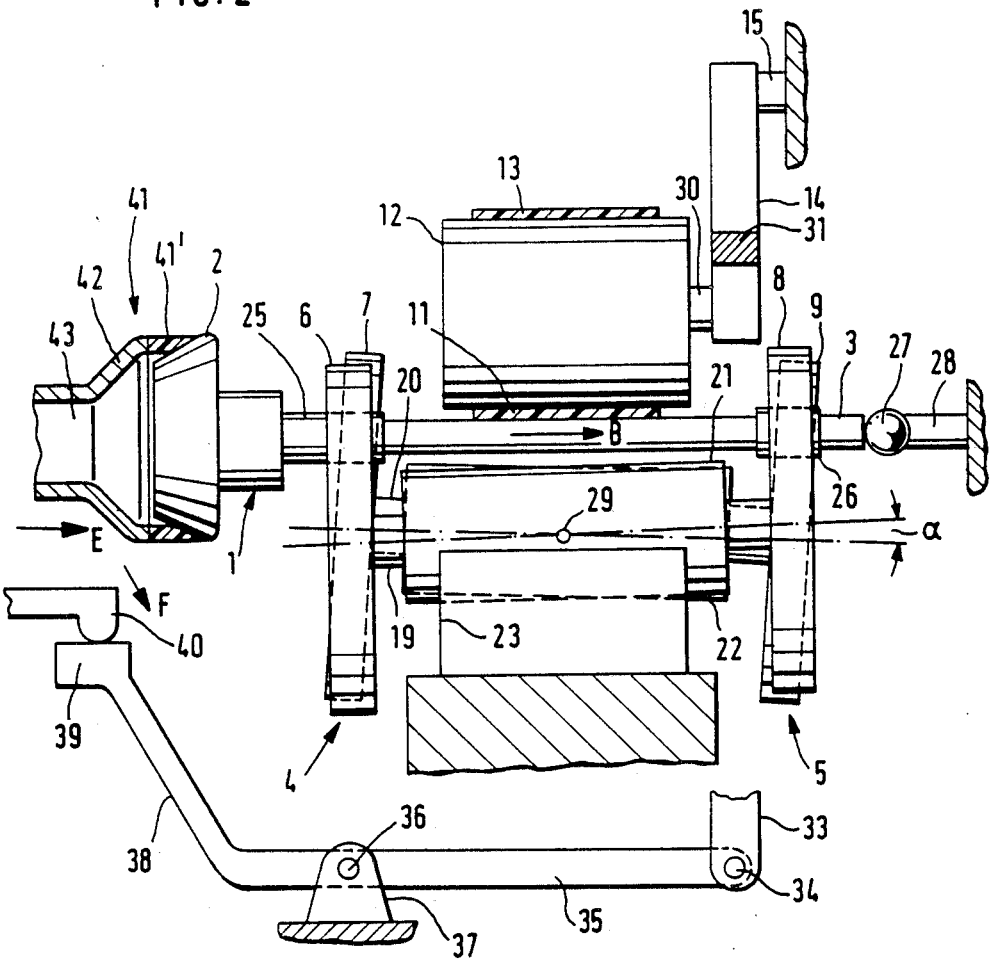
FIG. 2 is a lateral view of the bearing of FIG. 1.
Figure 3:
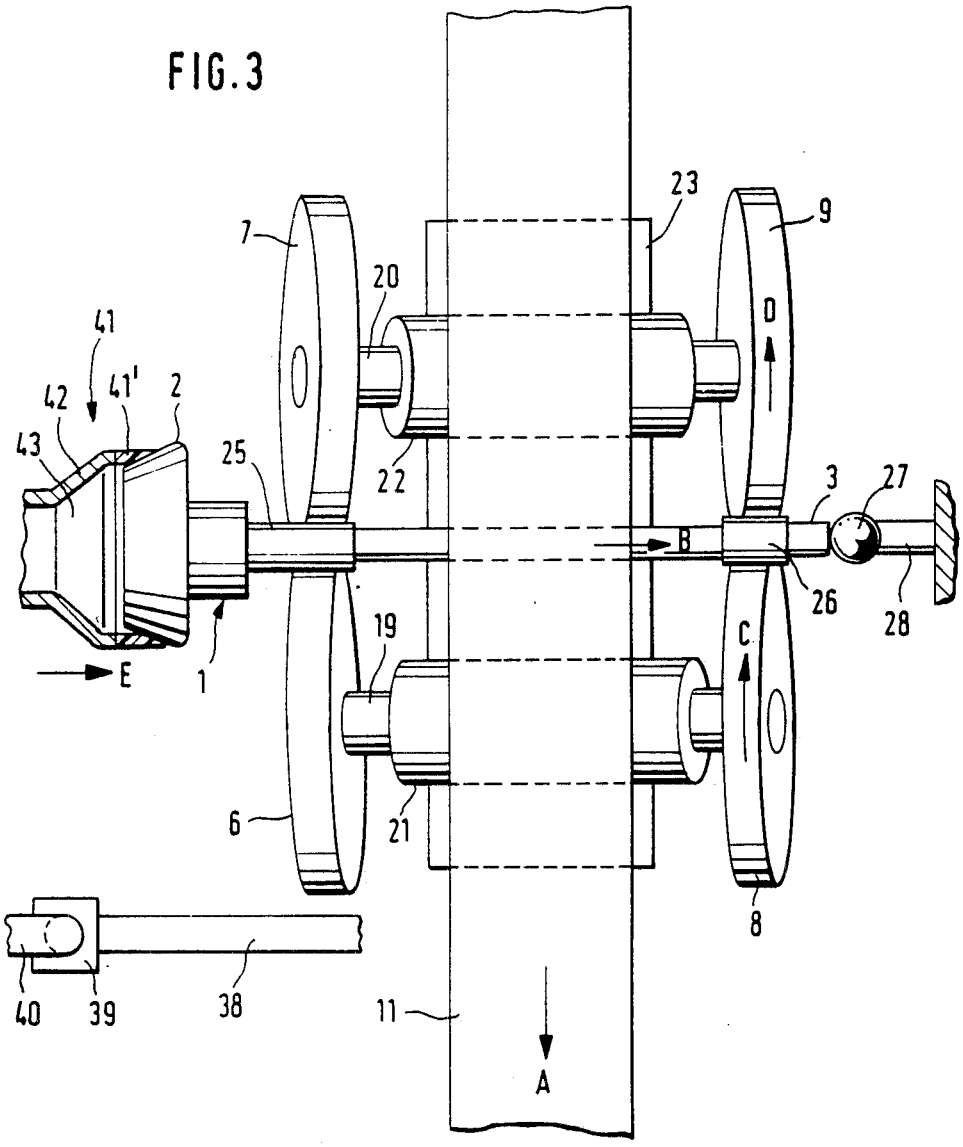
FIG. 3 is a top view of the bearing of FIGS. 1 and 2.

Referring now to FIGS. 1 to 3, the spinning rotor 1 exhibits a rotor 2 and a shaft 3.

The rotor 2 is pressed onto the shaft 3 by means of a ring collar and has a hollow interior that is open on the side facing away from the shaft 3. The shape of the inside space corresponds approximately to the outside contour of the rotor plate. On the open side, a sliding wall starts for the fed fibers which subsequently changes into a fiber collecting groove which is located in the area of the largest diameter of the rotor 2.

The shaft 3 of the spinning rotor assembly 1 is disposed radially in wedge-shaped gaps 10 formed by two pairs 4 and 5 of supporting disks. The pairs 4 and 5 of supporting disks each consist of two supporting disks 6, 7 and 8 and 9 which each have a metallic disk-shaped basic form 17 which, at its circumference, is equipped with a fitting 18 consisting of a plastic ring. The circumference of the ring forms the bearing surface for the shaft 3. The supporting disks 6, 8 and 7, 9 which are located on separate sides of the shaft 3 are arranged on joint shafts 19 and 20 which, by means of roller bearings, are disposed in bearing housings 21 and 22. The bearing housings 21 and 22 are arranged in arcuate receiving means of a joint bearing block 23 in which they are secured by holding means 24 designed as spring clips. The shafts 19 and 20, as shown in a top view in FIG. 3, are located in planes that are parallel to one another. In transverse direction to this plane, i.e., in the longitudinal direction of a tangential belt 11 driving the shaft 3, these shafts are angularly separated by an angle of about 1°, relative to axis 29 extending approximately in the center between the pairs 4 and 5 of supporting disks. The setting angle is built into the arcuate receiving means of the bearing block 23 so that the shafts 19 and 20, when their bearing housings 21 and 22 are placed in the bearing block 23, are aligned correspondingly.

The tangential belt 11 extending approximately in the center between the pairs 4 and 5 of supporting disks, moves along directly against the shaft 3 and secures it in the wedge-shaped gap 10 of the pairs 4 and 5 of supporting disks. The tangential belt 11 is biased with a pressure pulley 12 which biases the tangential belt 11 in the direction of the shaft 3 and deflects it slightly with respect to the shaft. The returning end 13 of the tangential belt 11 is returned on top on the pressure pulley 12. Axle 30 of the pressure pulley 12 is disposed rotatably on an arm 14 that can be swivelled around a stationary axis 15. The arm 14 is loaded with a loading spring 16 in the direction of the tangential belt 11 and the rotor shaft 3.

By means of the setting of the shafts 19 and 20 in connection with the moving direction A of the tangential belt 11 as well as in connection with the resulting rotating directions C and D of the pairs 4 and 5 of supporting disks, the supporting disks 6, 7, 8 and 9, subject the shaft 3 of the spinning rotor assembly 1 to an axial force away from the rotor 2 in the direction of the Arrow B. The shaft 3, in the axial direction, is supported against this axial force by a step bearing ball 27 which itself, is supported by a bolt 28 that is essentially resilient in the radial direction with respect to the shaft 3.

In the case of the embodiment according to FIGS. 1 to 3, the rotor shaft 3 has a decreased diameter in the area between the two pairs 4 and 5 of supporting disks, while the areas that contact the pairs 4 and 5 of supporting disks are designed as enlarged ring collars 25 and 26 which move on the fittings 18 of the pairs 4 and 5 of supporting disks. The ring collar 25 is extended up to the rotor 2 so that the rotor 2, with its ring collar, is pressed onto the ring collar 25. In order to protect the rotor shaft 3 from wear, it is provided with a coating consisting of silicon carbide or containing silicon carbide particles placed in a metallic matrix. It would actually be sufficient to coat only the area of the ring collars 25 and 26 but the application of the layer is simpler when the rotor shaft 3 as a whole is coated.

In order to disengage the drive of the shaft 3 of the spinning rotor assembly 1, the arm 14 with the pressure roller 12 arranged laterally next to the shaft 3 is lifted against the spring 16. The tangential belt 11, by means of guide pulleys (not shown) is guided in such a way that, when the pressure pulley 12 is moved away, it disengages itself from the shaft 3 of the spinning rotor assembly 1. The arm 14 is provided with an extension 31 at which an adjusting lever 33 is applied via a joint 32. The adjusting lever 33, via another joint 34, is connected with an operating lever 35 that is pivotable around a stationary shaft 36 of holding means 37. The operating lever 35 protrudes from the operating side of the spinning unit with one arm 38. A thrust piece 39 forms the end of the arm 38. An operating member 40 of a movable servicing apparatus is applied to the thrust piece 39. For the purpose of being swivelled in the direction of the Arrow F, member 40 is connected to a drive that is not shown. The movable servicing apparatus (see also FIGS. 11 and 12) can be moved along the open-end spinning machine and can be selectively applied to the individual spinning units.

The movable servicing apparatus also has a brake 41 which can be applied to the rotor 2 in the axial direction. The brake 41 has a brake lining 41' that is adapted to the conical outside contour of the rotor 2. This brake lining 41' is mounted on a bell-shaped component 42, which in the direction of the Arrow E can be applied axially to the rotor 2 by the servicing apparatus. The bell-shaped component 42 is extended via pipe 43 through which a cleaning device that is not shown can be applied to the rotor 2. If required, the bell-shaped component 42 can be connected to a vacuum source via the pipe 43, for the removal of the detached dirt particles. The rotor brake 41, by means of the brake lining 41' clamping onto the rotor 2 on the outside, presses the spinning rotor assembly 1 with its shaft 3 against the step bearing ball 27. This step bearing ball 27, during the braking, is clamped between the brake lining 41' and the step bearing ball 27. Accordingly, it is secured axially in the operating position even when the tangential belt 11 and the pressure pulley 12 are lifted off.

In the following developments of the present invention, the same reference numbers are used as were used in the embodiment according to FIGS. 1 to 3 to the extent that these refer to components which at least in their function correspond to components that have been described.

Figure 4:
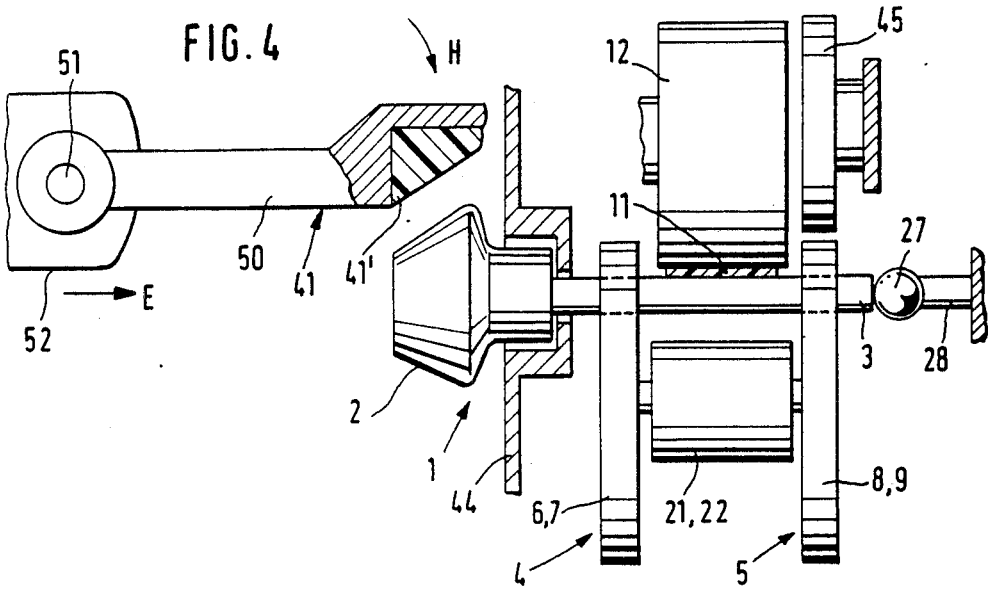
FIG. 4 is a view similar to that of FIG. 2 of another embodiment having a supporting disk that can be applied to the shaft of the spinning rotor.
Figure 5:
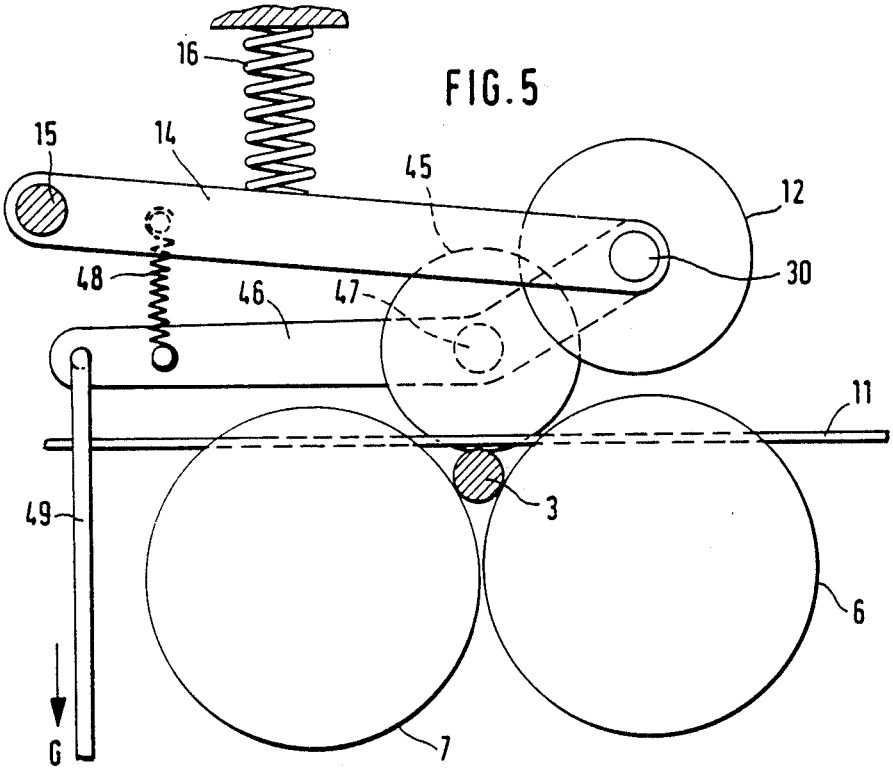
FIG. 5 is a partial cut view in the axial direction of the shaft of the spinning rotor of FIG. 4.

In the case of the development according to FIG. 4 and 5, the spinning rotor assembly 1 and its bearing as well as its drive are shown in operating condition in FIG. 4. In FIG. 5, the drive of the spinning rotor assembly 1 is interrupted. The shaft 3 of the spinning rotor assembly 1 disposed in the pairs 4 and 5 of supporting disks is driven by a tangential belt 11 which, by means of a pressure pulley 12 slightly deflecting the tangential belt 11 next to the shaft, is pressed against the shaft 3. The pressure pulley 12 by means of shaft 30 is disposed on arm 14 that can be swivelled around a stationary axle 15 and is biased by a spring 16 in the direction of the tangential belt 11. At the shaft 30, another arm 46 is linked that has a pressure disk 45 that can be rotated around a shaft 47. This pressure disk 45 is applied to the shaft 3 of the spinning rotor assembly 1 in such a way that it holds the shaft 3 in the wedge-shaped gap 10 between the pairs 4 and 5 of supporting disks when the pressure pulley 12 and the tangential belt 11 are lifted off. A tension spring 48 is arranged between the arm 14 and the arm 46. A connecting rod 49 is applied to the free end of the arm 46. The connecting rod 49 in the direction of the arrow G, i.e., in the direction toward the tangential belt 11 and the shaft 3, is operable in a manner that is not shown in detail by the movable servicing apparatus. During the operation, the pressure disk 45 is applied to the shaft 3. In the case of a further movement of arm 46, via the connecting rod 49, the contact point of pressure disk 45 on the shaft 3 forms an axis of rotation around which the arms 14 and 46 can then be swivelled jointly moving the pressure pulley 12, against the effect of the spring 16, away from the tangential belt 11. When the connecting rod 49 is released again, the pressure disk 45, because of the effect of the tension spring 48, moves away from the shaft 3 while at the same time, the pressure pulley 12, because of the effect of the spring 16, is again applied to the tangential belt 11.

The pressure disk 45 of the development according to FIG. 4 and 5 causes a clear securing of the position of the shaft 3 of the spinning rotor 1, so that the spinning rotor 1, also after the interruption of the drive, is held in an exactly defined position. It is then possible, as shown in FIG. 4, to apply a brake 41 to the rotor 2 on one side without the spinning rotor having to carry out a tilting movement by means of which it may, for example, run against an opening of the housing 44. The brake 41 is part of a movable servicing apparatus which is applied to the corresponding spinning unit. It has a guiding part 52 that can be applied to the spinning rotor assembly 1 in the axial direction corresponding to the Arrow E. It also has a lever arm 50 mounted at the guide part 52 and able to be swivelled around an arbor 51. The lever arm 50 carries a brake lining 41' that engages with the outside of the rotor 2.

In the development according to FIG. 6, the operating position of the shaft 3 is secured by a stationary stop 58 designed as a guiding sleeve which surrounds the shaft 3 with a small amount of radial play. The guiding sleeve 58 which advantageously has a slideway lining for the shaft 3 is part of a housing in which the step bearing ball 27 and the bolt 28 are housed.

The brake 41 of the development according to FIG. 6 has grippers 53 and 54 that can be swivelled around a shaft 55 in a tong-type manner. The grippers 53 and 54, at their ends, carry brake linings 41' which clamp the rotor 2 between them. The brake linings 41' have a conically sloped interior surface 61 that is adapted to the outside contour of the rotor 2. The tong-type grippers 53 and 54 are arranged within a tube-shaped guiding part 57 and are supported against its inside wall by means of elastic rings 56. When the brake linings 41' are applied to the rotor 2, they can adjust themselves to a certain extent with respect to the rotor 2. The applying motion taking place axially with respect to the spinning rotor assembly 1 during which the brake linings 41' come to rest against the rotor 2, is sufficient for the braking. In addition, the tong-type grippers 53 and 54 are tightened by additional elements by means of a guide ring which within the tube-shaped guide part 47 can be applied to the outside areas of the tong-type grippers 53 and 54.

In deviation from the development according to FIG. 6, it is provided in another development that the brake linings 41' have a profiling that is adapted to the outside contour of the rotor 2 and during the application reach around the rotor 2 in the area of its largest diameter from the outside and engage the rotor 2 there. In this case, the tong-type grippers are sufficient for fixing the rotor 2 and thus also the shaft 3 of the spinning rotor assembly in its operating position during braking when the drive is disengaged.

In the development of FIG. 6, it is also provided that the brake 41, when it is applied to the rotor 2, is centered precisely with respect to the rotor 2. For this purpose, a centering bolt 59, via a holding means, is mounted at the guide part 57. The centering bolt 59, when guide part 57 is applied axially to the spinning rotor assembly 1, moves into a centering piece 60 having a funnel-shaped entrance opening 60'. The centering piece 60 is arranged in a stationary manner at the spinning unit at a distance from the rotor 2 that is exactly defined. Advantageously, at least two such centering devices are provided which cause a centering of the guide part 57 and thus of the brake 41 in two planes extending at a right angle to one another.

In practice, it is useful to provide more than two tong-type grippers 53 and 54. Preferably, corresponding to FIG. 7, three such grippers having brake linings 41' are used at uniform angular distances of 120° each.

In the case of the development according to FIG. 8, a brake 41 provided with brake linings 41' is applied axially to the rotor 2 of a spinning rotor assembly 1 of a spinning unit. The said brake linings 41' having a brake surface 61 that is complementary to the outside contour of the rotor 2. The holding means 62 which each carry a segment of a brake lining 41' are subdivided by axial slots 63 so that they are elastically flexible in the radial direction to the rotor 2. It is advantageous to provide more than two segments for the brake linings 41' and more than two holding means 62, especially three holding means 62 corresponding to the embodiment according to FIG. 7 that are arranged at an angular distance of 120°.

Figure 9:
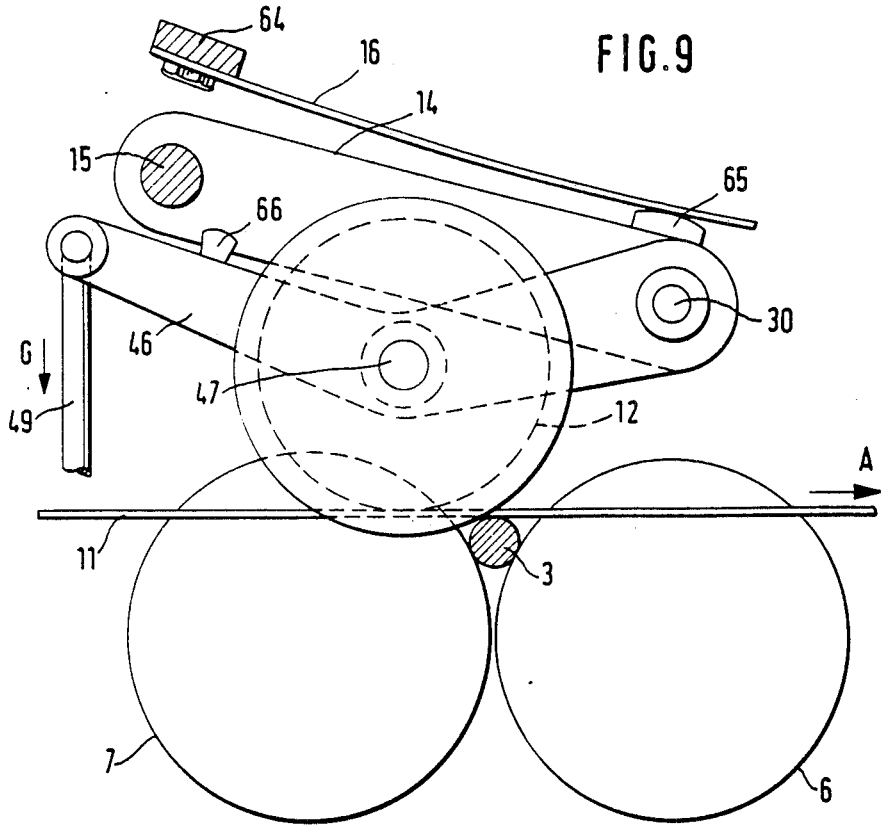
FIG. 9 is a view that is similar to that of FIG. 1 having a combined pressure pulley and supporting disk.
Figure 10:
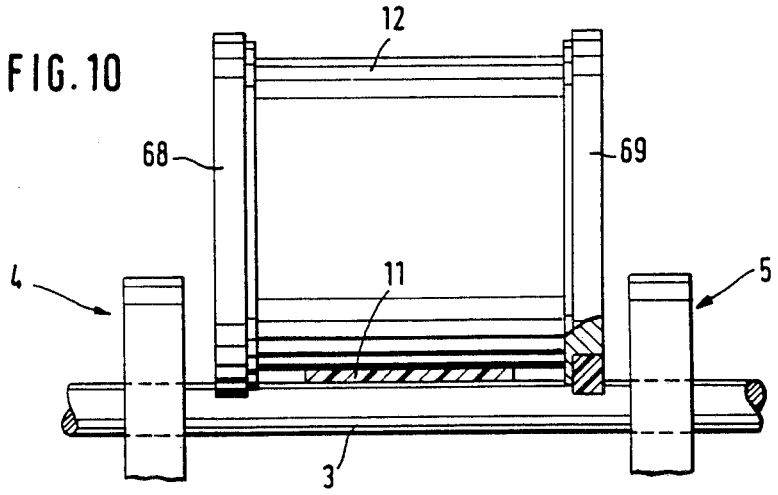
FIG. 10 is a lateral view of the combined pressure pulley and supporting disk of FIG. 9.

In the case of the development according to FIG. 9 and 10, a pressure pulley 12 is combined with two pressure disks 68 and 69 that can be applied to the shaft 3 of a spinning rotor assembly 1. The pressure pulley 12 with one shaft 47 is disposed on an arm 46. One end of arm 46, via a shaft 30, is linked to an arm 14 that can be swivelled around a stationary shaft 15. The arm 14 is biased with a leaf spring 16, one end of which is fastened via a holding means 64 in a stationary manner, and the other end of which rests against a thrust piece 65 of the arm 14. The end of the arm 46 that is returned to the area of the stationary arbor 15 is linked to a tension rod 49. In the direction of the Arrow G, i.e., in the direction of the tangential belt 11, the rod 49 can be moved by a movable servicing apparatus in a manner that is not shown in detail. The pressure pulley 12 has a smaller diameter than the two pressure disks 68 and 69 arranged laterally to it. In an area next to the shaft, pulley 12 rests against the tangential belt 11 in the operating condition, the pressure disks 68 and 69 being at a short distance to the shaft 3. By a pulling on the tension rod 49 in the direction of the Arrow G, the pressure pulley 12 together with the disks 68 and 69 is swivelled. As soon as the disks 68 and 69 come to rest against the shaft 3, this contact point, when the tension rod 49 and the arm 46 are moved further, forms a point of rotation for the lever system consisting of the arms 14 and 46. The arm 14 will then swivel around the stationary shaft 15 away from the tangential belt 11, the disks 68 and 69 moving toward the center of the wedge-shaped gap 10. In the process, the pressure pulley 12 moves away from the tangential belt 11 so that the drive is disengaged. When the tension rod is released again, the arms 14 and 46, because of the effect of the leaf spring 16, move back into the operating position shown in FIG. 9, in which the disks 68 and 69 come free of the shaft 3 again while the pressure pulley 12 again biases the tangential belt 11. The arm 46 will then rest against stop 66 of the arm 14.

The pressure disks 68 and 69 are advantageously provided with a plastic coating. There is, for example, a coating of the material that is known under the tradename of "Vulkolan," so that they are applied to the shaft 3 in a manner that is similar to that of the pairs 4 and 5 of supporting disks.

In a simple development, the disks 68 and 69 are mounted as ring collars on the pressure pulley 12. If, however, for constructive reasons, the diameter differences between the pressure pulley 12 and the disks 68 and 69 and thus the difference in their circumferential speeds should become larger, it is advantageous to arrange the disks 68 and 69 so that they are freely rotatable.

Figure 11:
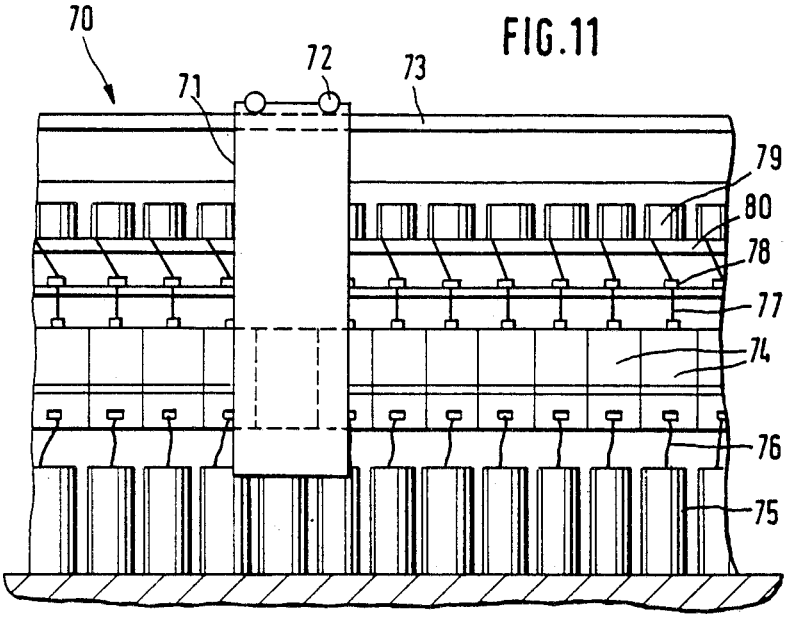
FIG. 11 is a front view of a part of an open-end friction spinning machine having a movable servicing apparatus in accordance with the present invention.
Figure 12:
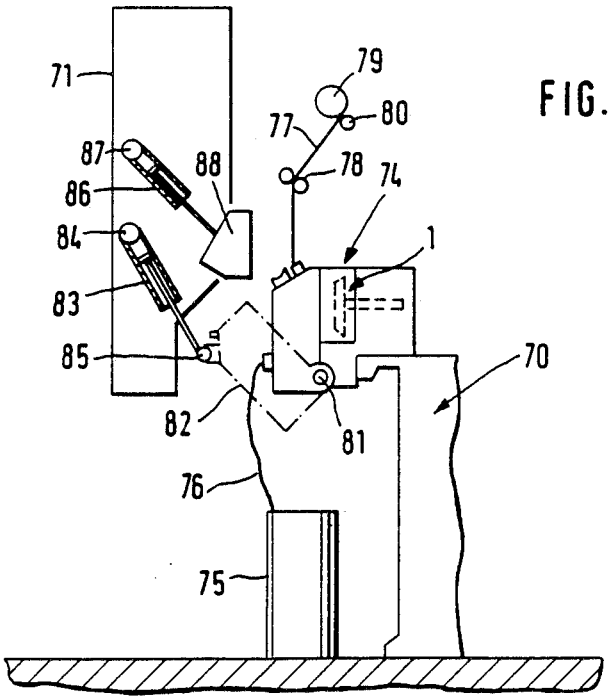
FIG. 12 is a lateral view of an open-end spinning machine having a servicing apparatus according to FIG. 11.

FIGS. 11 and 12 show an open-end spinning machine 70, having a movable servicing apparatus 71, equipped with the bearings and drives for the spinning rotor assemblies 1 explained in FIGS. 1 to 10 and the braking devices. The open-end spinning machine 70 is provided with driving rails 73 extending in its longitudinal direction, on which the servicing apparatus 71 can be moved by means of running wheels 72. The servicing apparatus 71 which may be especially intended for carrying out a piecing process after a yarn breakage (in a manner that is not shown in detail) is provided with a travelling mechanism which is designed in such a way that when servicing is required, the servicing apparatus 71 is applied to the spinning unit 74 in need of servicing. The open-end spinning machine 70 has a plurality of spinning units 74 that are arranged next to one another and are identical to one another. A sliver 76 is fed to each spinning unit 74 from a can 75 which in the spinning unit 74 is spun into a yarn 77 which is withdrawn via a withdrawal device 78 and is wound onto a spool 79 which is driven by a drive shaft extending in the longitudinal direction of the machine.

As shown in FIG. 12, each spinning unit 74 is equipped with a partial housing 82 that can be swivelled around a shaft 81. The partial housing 82, in the case of a maintenance requirement, is swivelled away for exposing the spinning rotor assembly 1. For this purpose, the servicing apparatus 71 has an opening device 83 that can be pivoted around a shaft 84 and with an opening head 85 is applied to the partial housing 82. The servicing apparatus 71 also contains an extending device 86 that can be pivoted around a shaft 87 for a head 88. This head 88 contains a brake corresponding to the above-described developments, by means of which the rotor 2 of the spinning rotor assembly 1 is stopped. In a manner that is not shown in detail, the servicing apparatus 71 also contains the operating member 40 (see FIG. 2) by means of which the drive of the spinning rotor assembly 1 of the concerned spinning unit is interrupted and by means of which a pressure disk is applied to the rotor shaft 3.

Although the invention has been described and illustrated in detail, it is to be clearly understood that the above is to be taken by way of illustration and example only and not by way of limitation. The spirit and scope of the invention are to be limited only by the terms of the appended claims.

What is claimed is:

1. An open-end spinning machine having a plurality of spinning units arranged adjacent one another and each containing a spinning rotor assembly formed by a rotor and a shaft, said shaft radially disposed in a wedge-shaped gap formed by a pair of supporting disk means and driven by tangential belt means, said tangential belt means being biased against said shaft by a pressure pulley means during normal operation, comprising:

servicing apparatus means having brake means capable of being being directly applied to said rotor for stopping said spinning rotor assembly; and securing means operable separately from said brake means for securing said spinning rotor assembly in an operating position when said belt means is disengaged from said shaft, wherein said securing means includes means selectively movable from an inoperable position to an operable position in engagement with the rotor shaft.

2. An open-end spinning machine according to claim 1, wherein said securing means for securing said spinning rotor assembly in an operative position are part of movable service unit means for servicing said spinning units, said movable servicing unit means being capable of being selectively applied to individual spinning units.

3. An apparatus according to claim 1, wherein said brake means include gripper means, said gripper means having brake shoe means capable of being applied to said rotor.

4. An open-end spinning machine according to claim 3, wherein said brake shoe means are capable of being applied to said rotor in an axial direction relative to said shaft.

5. An open-end spinning machine according to claim 4, wherein said rotor has a first outer contour and said brake shoe means have a surface capable of engaging around said outer contour for fixing said spinning rotor.

6. An open-end spinning machine according to claim 3, wherein said brake lining is divided into at least two circumferential segments, said segments being held in a radial direction by means of elastically resilient holder means.

7. An open-end spinning machine according to claim 1, wherein said brake means are capable of being applied against said rotor in an axial direction relative to said shaft, said shaft being capable of being supported in said axial direction by stop means.

8. An open-end spinning machine according to claim 1, wherein said rotor has a conical exterior contour and said brake means has a brake lining capable of being applied to said exterior contour in an axial direction relative to said shaft, said brake lining having a contour complementary to said conical contour of said rotor exterior.

9. An open-end spinning machine according to claim 8, wherein said brake lining comprises a plurality of circumferential segments, said segments being radially held by means of elastic resilient holders.

10. An open-end spinning machine according to claim 1, wherein said brake means include centering means for centering said brake means with respect to said rotor.

11. An open-end spinning machine according to claim 10, wherein said centering means comprises centering element means engageable with counter piece means mounted on said spinning unit.

12. An open-end spinning machine according to claim 1, wherein each said spinning unit includes position fixing means for fixing an operating position of said shaft of said spinning rotor.

13. An open-end spinning machine according to claim 12, wherein each spinning unit has stationary stop means adjacent said shaft.

14. An open-end spinning machine according to claim 13, wherein said stop means includes slide way lining means for engaging said shaft.

15. An open-end spinning machine according to claim 12, wherein said position fixing means comprises pressure disk means, said pressure disk means being capable of being applied to said shaft by movable servicing unit means.

16. An open-end spinning machine according to claim 15, wherein said pressure disk means are mounted on holding element means supporting pressure pulley means, said pressure disk means being capable of being applied to said shaft when said pressure pulley means is disengaged.

17. An open-end spinning machine according to claim 16, wherein said pressure pulley means and said pressure disk means are disposed coaxially on support arm means.

18. An open-end spinning machine according to claim 17, wherein said pressure disk means has a larger diameter than said pressure pulley means and wherein said support arm means is movably disposed adjacent said shaft, said pressure disk means being capable of engaging said shaft.

19. An open-end spinning machine according to claim 1, wherein said servicing apparatus means is carried on movable servicing unit means capable of being selectively applied to individual spinning units.

20. An open-end spinning machine having a plurality of spinning units arranged one another and each containing a spinning rotor assembly formed by a rotor and a shaft, said shaft being radially disposed in a wedge-shaped gap formed by a pair of supporting disk means and driven by tangential belt means, said tangential belt means being biased against said shaft by a pressure pulley means during normal operation, comprising:

securing means for securing said spinning rotor assembly in an operating position when said belt means is disengaged from said shaft, and servicing apparatus means having brake means capable of being directly applied to said rotor for stopping said spinning rotor assembly, said brake means including gripper means, said gripper means having brake lining means capable of being applied to said rotor, and said brake lining means being divided into at least two circumferential segments, said segments being held in a radial direction by means of elastically resilient holder means.

21. An open-end spinning machine having a plurality of spinning units arranged adjacent one another and each containing a spinning rotor assembly formed by a rotor and a shaft, said shaft being radially disposed in a wedge-shaped gap formed by a pair of supporting disk means and driven by tangential belt means, said tangential belt means being biased against said shaft means by a pressure pulley means during normal operation, comprising:

securing means for securing said spinning rotor assembly in an operating position when said belt means is disengaged from said shaft, and servicing apparatus means having brake means capable of being directly applied to said rotor for stopping said spinning rotor assembly, said rotor having a conical exterior contour and said brake means having a brake lining capable of being applied to said exterior contour in an axial direction relative to said shaft, said brake lining having a contour complementary to said conical contour of said rotor exterior, said brake lining comprising a plurality of circumferential segments, said segments being radially held by means of elastic resilient holder means.

22. An open-end spinning machine having a plurality of spinning units arranged adjacent one another and each containing a spinning rotor assembly formed by a rotor and a shaft, said shaft being radially disposed in a wedge-shaped gap formed by a pair of supporting disk means and driven by tangential belt means, said tangential belt means being biased against said shaft means by a pressure pulley means during normal operation, comprising:

securing means for securing said spinning rotor assembly in an operating position when said belt means is disengaged from said shaft, and servicing apparatus means having brake means capable of being directly applied to said rotor for stopping said spinning rotor assembly, each said spinning unit including position fixing means for fixing an operating position of said shaft of said spinning rotor, said position fixing means comprising pressure disk means, said pressure disk means being capable of being applied to said shaft by movable servicing unit means, said pressure disk means being mounted on holding element means supporting pressure pulley means, said pressure disk means being capable of being applied to said shaft when said pressure pulley means is disengaged.

23. An open-end spinning machine according to claim 22, wherein said pressure pulley means and said pressure disk means are disposed coaxially on support arm means.

24. An open-end spinning machine according to claim 23, wherein said pressure disk means has a larger diameter than said pressure pulley means and wherein said support arm means is movably disposed adjacent said shaft, said pressure disk means being capable of engaging said shaft.

* * * * *